US008763325B2

(12) United States Patent
Rodriguez, Jr.

(10) Patent No.: US 8,763,325 B2
(45) Date of Patent: Jul. 1, 2014

(54) ADJUSTABLE ROOF JACK

(71) Applicant: Ventura S. Rodriguez, Jr., San Antonio, TX (US)

(72) Inventor: Ventura S. Rodriguez, Jr., San Antonio, TX (US)

(73) Assignee: Dot Metal Products

( * ) Notice: Subject to any disclaimer, the term of this patent is extended or adjusted under 35 U.S.C. 154(b) by 0 days.

(21) Appl. No.: 14/086,214

(22) Filed: Nov. 21, 2013

(65) Prior Publication Data

US 2014/0080404 A1 Mar. 20, 2014

Related U.S. Application Data

(63) Continuation-in-part of application No. 13/949,912, filed on Jul. 24, 2013, now Pat. No. 8,615,943, which is a continuation-in-part of application No. 13/343,994, filed on Jan. 5, 2012, now Pat. No. 8,534,013.

(51) Int. Cl.

| | |
|---|---|
| ***E04D 13/14*** | (2006.01) |
| ***E04B 7/00*** | (2006.01) |
| ***E04D 13/00*** | (2006.01) |

(52) U.S. Cl.

USPC ..... 52/219; 52/198; 52/199; 52/60; 52/97; 52/94

(58) Field of Classification Search

USPC ..... 52/219, 198–199, 60, 94–97

See application file for complete search history.

(56) References Cited

U.S. PATENT DOCUMENTS

| | | | | |
|---|---|---|---|---|
| 2,614,867 | A * | 10/1952 | Artis, Jr. | 285/44 |
| 2,909,113 | A * | 10/1959 | Hatcher | 454/36 |
| 3,082,677 | A * | 3/1963 | Pease | 454/47 |
| 3,742,659 | A * | 7/1973 | Drew | 52/19 |
| 4,189,989 | A * | 2/1980 | Maze | 454/38 |
| 4,526,091 | A * | 7/1985 | Sharp | 454/254 |
| 4,895,066 | A * | 1/1990 | Carnahan | 454/275 |
| 5,409,266 | A * | 4/1995 | Baker | 285/44 |
| 6,279,272 | B1 * | 8/2001 | Nill, Jr. | 52/58 |
| 6,932,690 | B2 * | 8/2005 | Ramsay | 454/66 |
| 7,114,301 | B2 * | 10/2006 | Bibaud et al. | 52/219 |
| 7,232,370 | B1 * | 6/2007 | Newell | 454/366 |
| 8,272,186 | B2 * | 9/2012 | Manning | 52/741.4 |
| 8,322,088 | B2 * | 12/2012 | Huang | 52/198 |
| 2004/0235412 | A1 * | 11/2004 | Ramsay | 454/368 |

* cited by examiner

*Primary Examiner* — Mark Wendell

(74) *Attorney, Agent, or Firm* — Jennifer Meredith, Esq.; Lippes Mathias Wexler Friedman LLP

(57) ABSTRACT

An adjustable roof jack, having: a flange; a first tapered cylinder fixedly connected to the flange; a second tapered cylinder rotationally connected to the first tapered cylinder; a vent cap tapered cylinder rotationally connected to the second tapered cylinder; and a vent cap assembly fixedly attached to the vent cap tapered cylinder.

20 Claims, 12 Drawing Sheets

ADJUSTABLE ROOF JACK

BACKGROUND OF THE INVENTION

1. Field of the Invention

The present invention pertains generally to vent exhaust pipes and, in particular, to roof jacks for vent exhaust pipes.

2. Description of Related Art

Roofs and other coverings over commercial, residential and recreational structures (hereinafter collectively referred to as "structure") often have openings configured to allow the penetration of vents, piping and other conduits (hereinafter collectively referred to as "conduit") into and out of the structure. For example, the roof of a structure may include conduits for ventilation piping or ducts, electrical, cable or any other reason that an opening in a structure may be required.

One technique used to cover a conduit is a traditional roof jack, as depicted in FIG. 1. When a conduit is passed through the roof to the exterior of the home to provide ventilation, a "roof jack" is typically installed over the pipe to prevent water from entering the structure. The roof jack covers the "mouth" of the pipe to prevent water from entering the pipe itself as well as to prevent water from entering the hole that is cut into the roof. There is a square flange (10), a cylinder (12) and a vent cap (14). While such prior art systems provide ventilation, a problem arises because different structures often have a different roof "pitch" a different degree of slope. Roofs generally range from zero degrees of angle to 45 degrees. In order to keep a roof jack's cylinder vertical while the flange/flashing is flush with the roof surface, multiple variations are constructed and manufactured for the particular slope or pitch of the roof on which the roof jack is to be used. This requires roof jack suppliers to maintain a relatively large inventory of roof jacks in order to accommodate the full range of slopes or pitch which are encountered in the building industry. There is also the issue of requiring multiple stock keeping units (SKU's). Roof jack suppliers are faced with the problem of high costs and high storage space if they want to be able to supply roof jacks accommodating the full range of slopes. This is also costly for those constructing the structure. For example, They may find out that during the installation the wrong pitch roof jack was ordered. This can cause costly delays and uncovered openings in the roof of the structure.

SUMMARY OF THE INVENTION

Aspects of the present invention provide a roof jack that may be installed to accommodate roof pitches from 0-45 degrees.

One aspect of the present invention provides an adjustable roof jack, the adjustable roof jack comprising: a flange; a first tapered cylinder having a first cylinder top portion and a first cylinder bottom portion, the first cylinder bottom portion fixedly connected to the flange and the first cylinder top portion having at least one first cylinder fold having a first cylinder fold raised portion; a second tapered cylinder having a second cylinder top portion and a second cylinder bottom portion, the second cylinder bottom portion having at least one second cylinder bottom fold having a second cylinder bottom fold raised portion and the second cylinder top portion having at least one second cylinder top fold having a second cylinder top fold raised portion, wherein the second cylinder bottom fold is folded over the first cylinder fold raised portion to fixedly and rotationally connect the second tapered cylinder to the first tapered cylinder; a vent cap tapered cylinder having a vent cap cylinder top portion and a vent cap cylinder bottom portion, the vent cap cylinder bottom portion having at least one vent cap cylinder fold having a vent cap cylinder fold raised portion, wherein the vent cap cylinder fold is folded over the second cylinder top fold raised portion to rotationally connect the vent cap tapered cylinder to the second tapered cylinder; and a vent cap assembly fixedly attached to the vent cap tapered cylinder top portion.

Another aspect of the present invention provides an adjustable roof jack, said adjustable roof jack comprising: an octagonal shaped flange; a first tapered cylinder having a first cylinder top portion and a first cylinder bottom portion, the first cylinder bottom portion fixedly connected to the octagonal shaped flange at a substantially zero degree angle and the first cylinder top portion having two first cylinder folds, one first cylinder fold being a v shaped fold having a first cylinder fold raised portion and a second first cylinder fold being an end slanted l shape and continuous with the one first cylinder fold being a v shaped fold; a second tapered cylinder having a second cylinder top portion and a second cylinder bottom portion, the second cylinder bottom portion having one second cylinder bottom v shaped fold having a second cylinder bottom fold raised portion and the second cylinder top portion having at least one second cylinder top fold having a second cylinder top fold raised portion, wherein the second cylinder bottom fold is folded over the second first cylinder fold being an end slanted l shape to fixedly and rotationally connect the second tapered cylinder to the first tapered cylinder; a vent cap tapered cylinder having a vent cap cylinder top portion and a vent cap cylinder bottom portion, the vent cap cylinder bottom portion having at least one vent cap cylinder fold having a vent cap cylinder fold raised portion, wherein the vent cap cylinder fold is folded over the second cylinder top fold raised portion to rotationally connect the vent cap tapered cylinder to the second tapered cylinder; and a vent cap assembly fixedly attached to the vent cap tapered cylinder top portion.

DETAILED DESCRIPTION OF THE INVENTION

Figure 1:
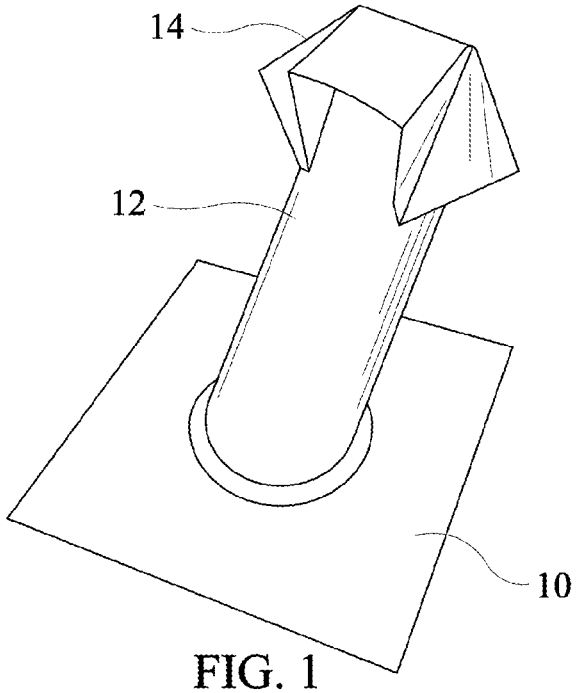
FIG. 1 PRIOR ART
FIG. 1 shows a prior art roof jack.
Figure 2:
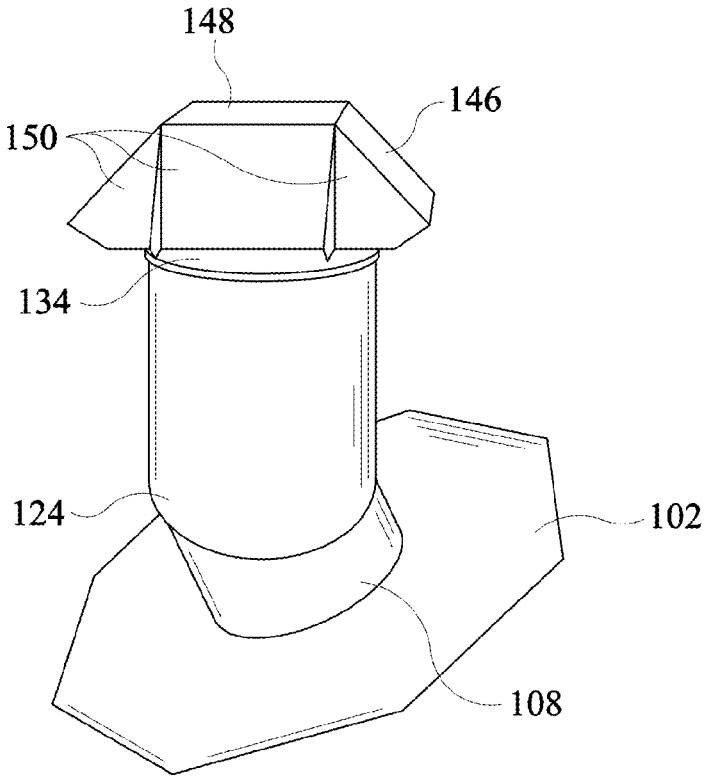
FIG. 2 shows a side view of a roof jack according to aspects of the present invention.
Figure 3:
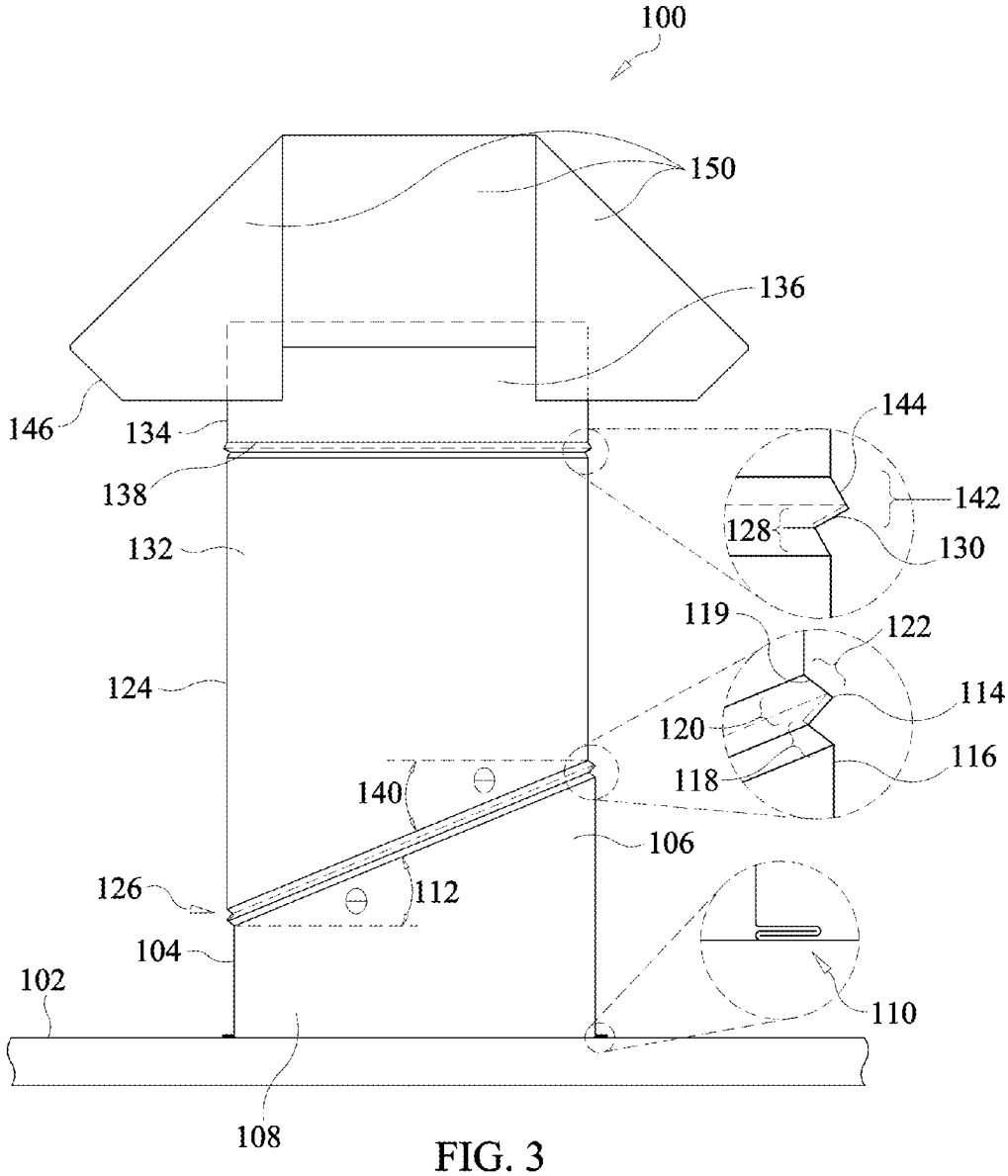
FIG. 3 shows a side view of a roof jack according to aspects of the present invention.
Figure 4:
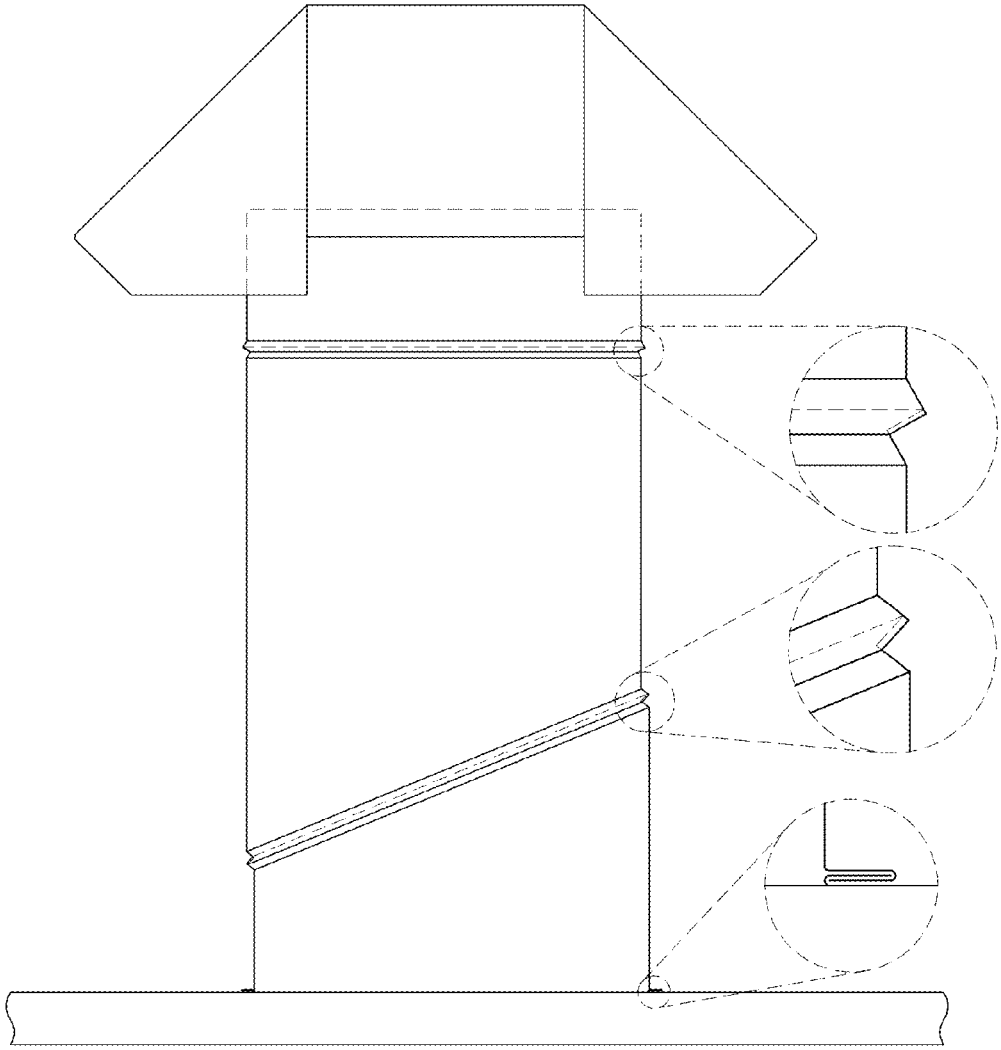
FIG. 4 shows a side view of a roof jack according to aspects of the present invention.
Figure 5:
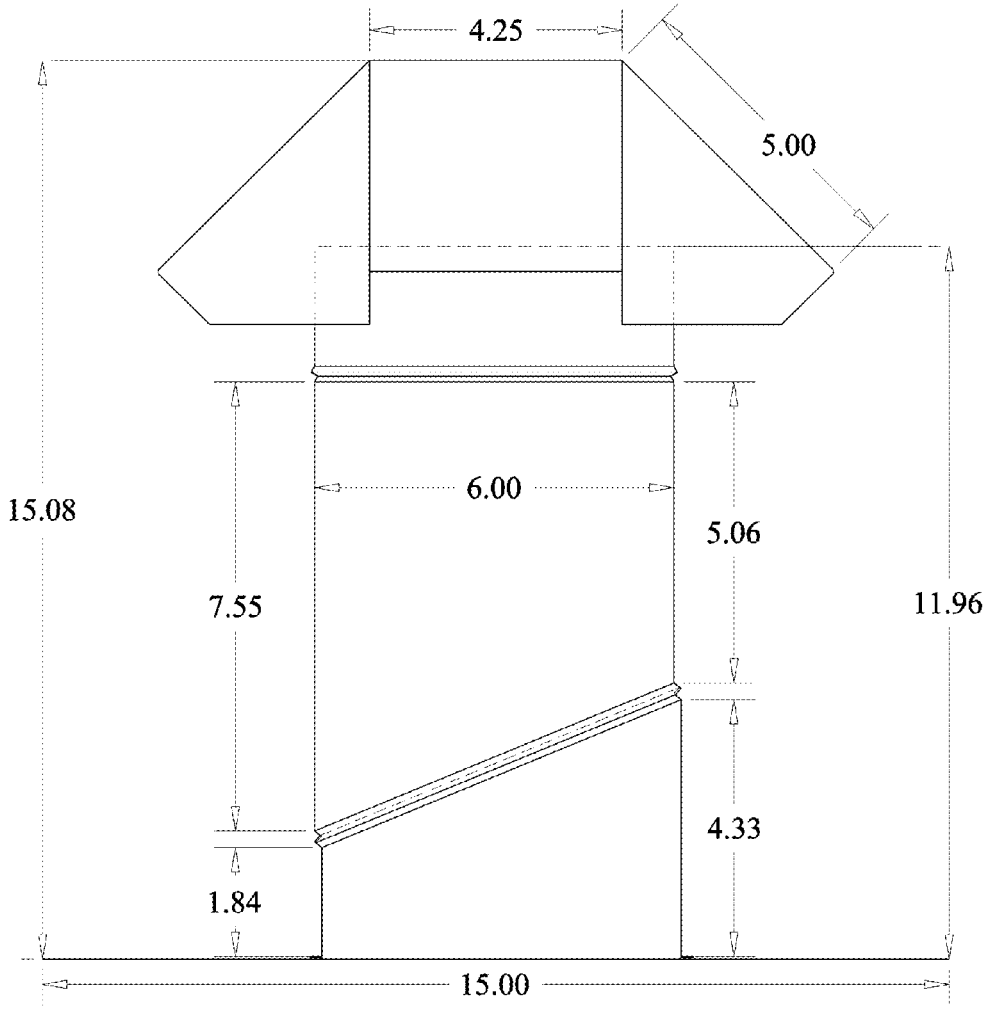
FIG. 5 shows a side view of a roof jack according to aspects of the present invention.

Aspects of the present invention provide a roof jack apparatus. As depicted in FIGS. 2-11, the present invention provides an adjustable roof jack (100). The following is a call out list of elements depicted in FIGS. 2-11: adjustable roof jack (100); an octagonal shaped flange (102); first cylinder (104); first cylinder top portion (106); first cylinder bottom portion (108); folded seam (110); angle (112); first cylinder fold (first) raised portion (114); first cylinder fold (second) raised portion (116); first cylinder fold (first) (118); second cylinder bottom fold (first) raised portion (119); first cylinder fold (second) (120); second cylinder bottom fold (first) (122); second cylinder (124); second cylinder bottom portion (126); second cylinder top fold (first) (128); second cylinder top fold (first) raised portion (130); second cylinder top portion (132); vent cap cylinder (134); vent cap cylinder top portion (136); vent cap cylinder bottom portion (138); angle (140); vent cap cylinder fold (142); vent cap cylinder fold raised portion (144); and vent cap assembly (146). Note, the embodiment shown has an octagonal shaped flange. The flange may be circular, square, rectangular, or any shape that completely encloses the opening adjustable vent cylinder (first cylinder 104). Each of the cylinder sections may be welded or riveted.

An adjustable roof jack (100), the adjustable roof jack comprising: a flange (102); a first cylinder (104) having a first cylinder top portion (106) and a first cylinder bottom portion (108), the first cylinder bottom portion (108) fixedly connected to the octagonal shaped flange (102) at a substantially zero degree angle (and surrounding a conduit in a structure) and the first cylinder top portion (106) being at an angle between 20 and 25 degrees and having at least one first cylinder fold (118) having a first cylinder fold raised portion (114); a second cylinder (124) having a second cylinder top portion (132) and a second cylinder bottom portion (126), the second cylinder bottom portion (126) being at an angle (140) between 65 and 70 degrees and having at least one second cylinder bottom fold (122) having a second cylinder bottom fold raised portion (119) and the second cylinder top portion (132) having at least one second cylinder top fold (128) having a second cylinder top fold raised portion (130), wherein the second cylinder bottom fold (122) is folded over the first cylinder fold raised portion (116) to fixedly and rotationally connect the second cylinder (124) to the first cylinder (104) at an angle (112) between 20 and 25 degrees. A vent cap cylinder (134) having a vent cap cylinder top portion (136) and a vent cap cylinder bottom portion (138), the vent cap cylinder bottom portion (138) having at least one vent cap cylinder fold (142) having a vent cap cylinder fold raised portion (144), wherein the vent cap cylinder fold (142) is folded over the second cylinder top fold raised portion (130) to rotationally connect the vent cap cylinder (134) to the second cylinder (124); and a vent cap assembly (146) fixedly attached to the vent cap cylinder top portion (136).

Figure 11:
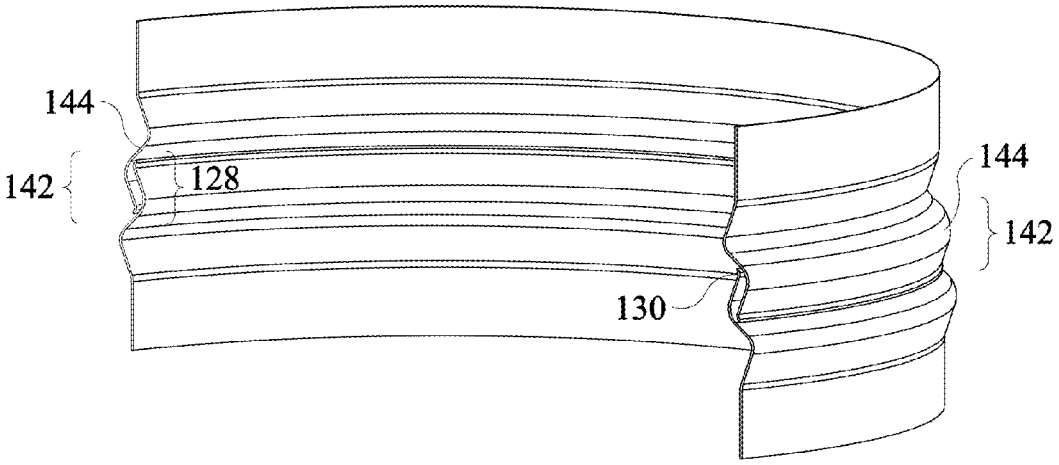
FIG. 11 depicts a cutaway inside view of a portion of the roof jack according to aspects of the present invention.

There may be a folded seam (110) along a bottom outside edge of the first cylinder bottom portion (108) and fixedly attached to the octagonal shaped flange (102). The folded seam (110) between the first cylinder bottom portion (108) and the flange (102) is not rotational. At least one of the first cylinder fold (118), second cylinder bottom fold (122), second cylinder top fold (128) and vent cap cylinder fold (142) may be v shaped. At least one of the first cylinder fold (118) and second cylinder top fold (128) may be an end slanted l shape. FIG. 11 depicts an end slanted l shape. The term "end slanted" refers to the end being slightly curved in to allow the v shaped vent cap cylinder fold (142) to smoothly rotate around second cylinder top fold (128). The vent cap may be many different shapes (an infinite number) without departing from the scope of the present invention. It is only required that there be a top that prevents water from entering the cylinders and there be at least one opening that allows for ventilation.

The at least one first cylinder fold may be two first cylinder folds (118, 120), one first cylinder fold (118) being a v shaped fold and a second first cylinder fold (120) being an end slanted l shape and continuous with the first cylinder fold (118). The first cylinder top portion (106) may be at an angle (112) substantially 22.5 degrees and the second cylinder bottom portion (126) may be at an angle (140) substantially 67.5 degrees. Note each of cylinders (e.g. first cylinder (104), second cylinder (124) and vent cap cylinder (134)) are connected by rotational seams. The term rotational seam refers to (1) the connection formed by the second cylinder bottom fold (122) folded over the first cylinder fold raised portion (116) to fixedly and rotationally connect the second cylinder (124) to the first cylinder (104); and (2) the connection formed by the vent cap cylinder fold (142) folded over the second cylinder top fold raised portion (130) to rotationally connect the vent cap cylinder (134) to the second cylinder (124)

The rotational seams cannot be separated, and provide for watertight interlocking rotation. The seam which connects the second cylinder (124) to the first cylinder (104) is 22.5 degrees; it allows the jack to accommodate each pitch from 0:12 through 12:12 (0-45 degrees). The seam connecting parts the second cylinder (124) and the vent cap cylinder (134) is 0.0 degrees; its purpose is to provide rotation of the cap, enabling the installer to align it with the roof's edge for aesthetic appeal.

The vent cap assembly (146) may be comprising: a square vent cap top (148) and at least two canopies (150), according to one embodiment four canopies, in communication with the vent cap top (148) that extend from the vent cap top (148) to at least halfway past the vent cap cylinder (134). The term canopy refers to an overhang projection. Note that it is open under the canopy to allow air to flow into and out of a conduit in the roof, a first cylinder (104), second cylinder (124) and vent cap cylinder (134).

Figure 12:
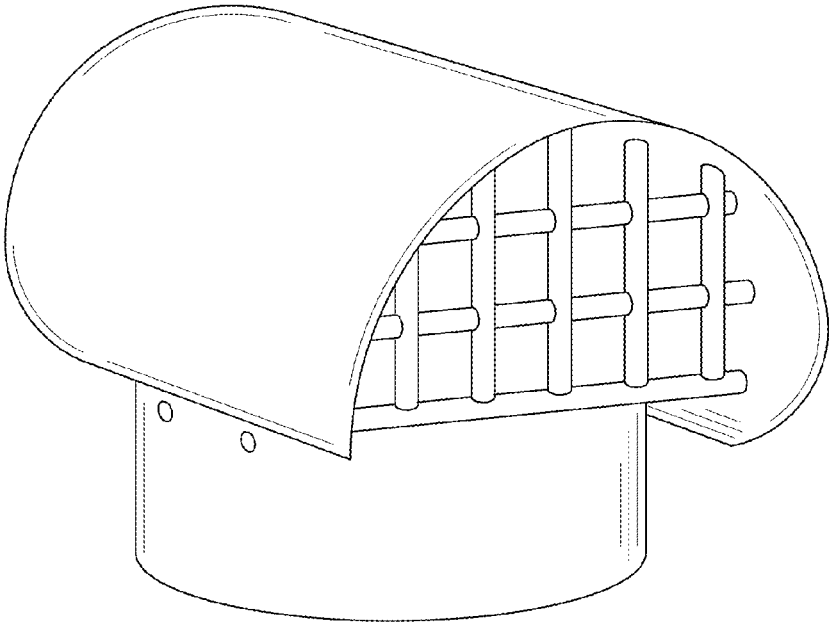
FIG. 12 depicts an alternate roof jack according to aspects of the present invention.

According to a preferred embodiment, an adjustable roof jack (100) is provided comprising: an octagonal shaped flange (102); a first cylinder (104) having a first cylinder top portion (106) and a first cylinder bottom portion (108), the first cylinder bottom portion (108) fixedly connected to the octagonal shaped flange (102) at a substantially zero degree angle and the first cylinder top portion (106) being at an angle between 20 and 25 degrees and having two first cylinder folds, one first cylinder fold (118) being a v shaped fold having a first cylinder fold raised portion (114) and a second first cylinder fold (120) being an end slanted l shape and continuous with the one first cylinder fold (118) being a v shaped fold; a second cylinder (124) having a second cylinder top portion (132) and a second cylinder bottom portion (126), the second cylinder bottom portion (126) being at an angle (140) between 65 and 70 degrees and having one second cylinder bottom v shaped fold (122) having a second cylinder bottom fold raised portion (119) and the second cylinder top portion (132) having at least one second cylinder top fold (128) having a second cylinder top fold raised portion (130), wherein the second cylinder bottom fold (122) is folded over the second first cylinder fold (120) being an end slanted l shape to fixedly and rotationally connect the second cylinder (124) to the first cylinder (104) at an angle (112) between 20 and 25 degrees; a vent cap cylinder (134) having a vent cap cylinder top portion (136) and a vent cap cylinder bottom portion (138), the vent cap cylinder bottom portion (138) having at least one vent cap cylinder fold (142) having a vent cap cylinder fold raised portion (144), wherein the vent cap cylinder fold (142) is folded over the second cylinder top fold raised portion (130) to rotationally connect the vent cap cylinder (134) to the second cylinder (124); and a vent cap assembly (146) fixedly attached to the vent cap cylinder top portion (136). The vent cap assembly having a square vent cap top; and four canopies in communication with the square vent cap top that extend from the vent cap top to at least halfway past the vent cap cylinder. According to alternate embodiments, the vent cap assembly may have a vent cap top that is a square vent cap, round vent cap or wagon vent cap (as shown in FIG. 12).

There may be a folded seam (110) along a bottom outside edge of the first cylinder bottom portion and fixedly attached to the octagonal shaped flange. This would create a watertight seal between the first cylinder bottom portion (108) and the octagonal shaped flange (102).

According to a preferred embodiment, the first cylinder top portion (106) is cut at 22.5 degrees. According to one embodiment, there are two first cylinder folds (118 and 120). One first cylinder fold (118) is a v shaped fold and has a raised portion (114). A second first cylinder fold (120) is an end slanted l shape and has a raised portion (116). The second first cylinder fold (120) meets the one first cylinder fold (118), which is to say where one ends the other begins.

Figure 6:
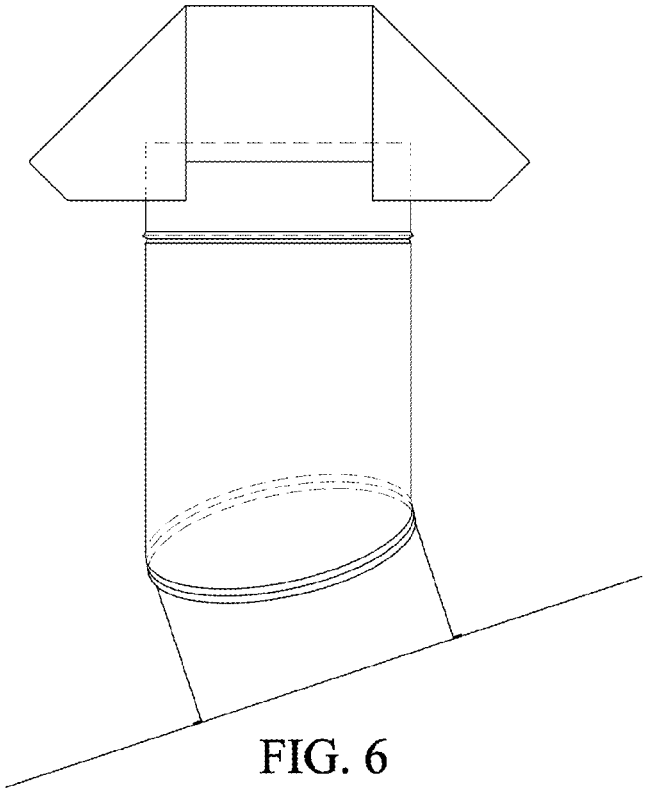
FIG. 6 shows a side view of a roof jack installed on a roof according to aspects of the present invention.
Figure 7:
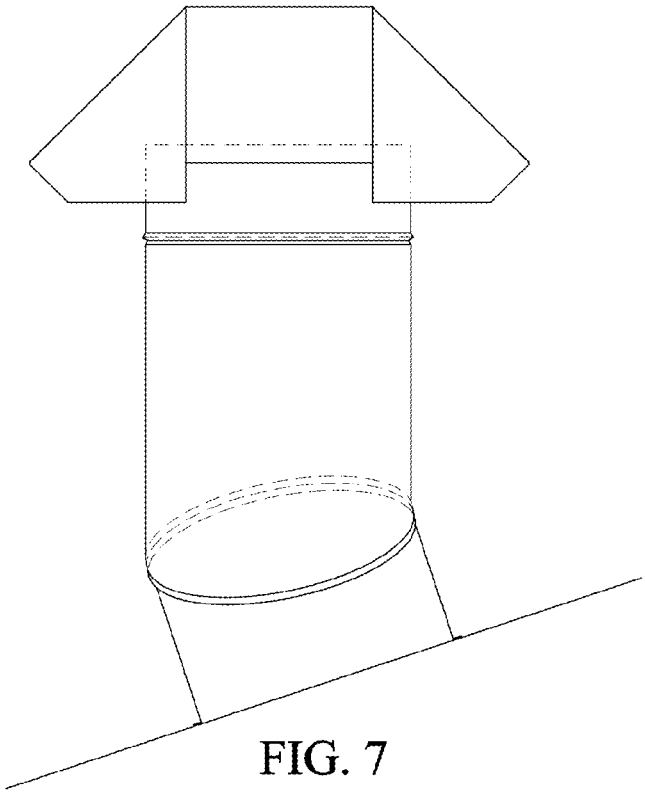
FIG. 7 shows a side view of a roof jack installed on a roof according to aspects of the present invention.
Figure 8:
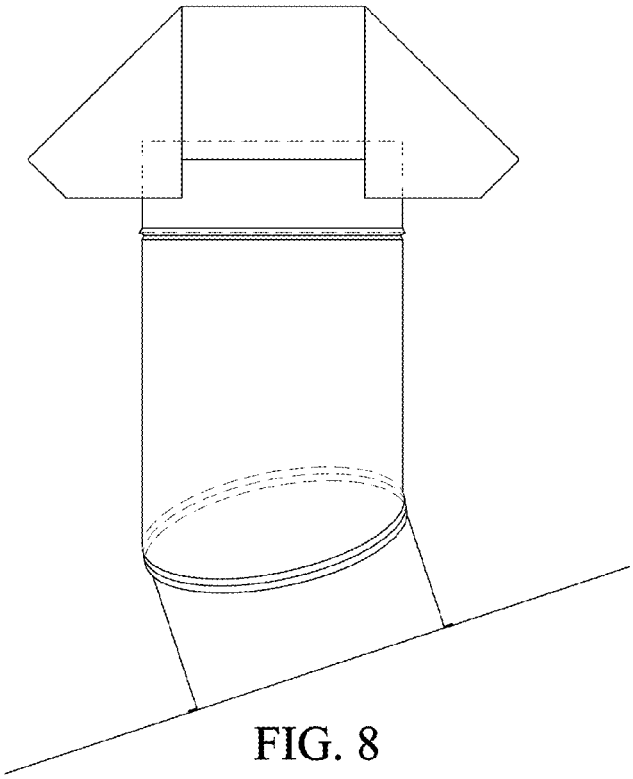
FIG. 8 shows a side view of a roof jack installed on a roof according to aspects of the present invention.
Figure 9:
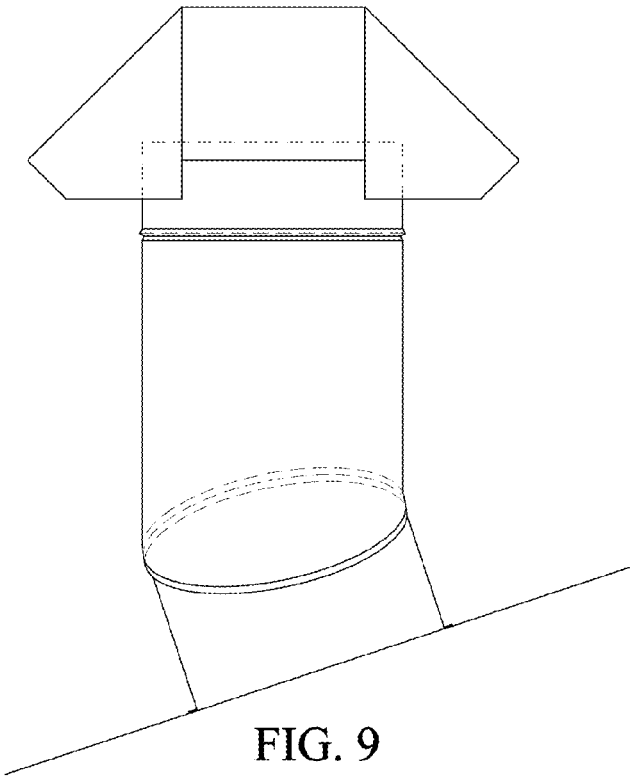
FIG. 9 shows a side view of a roof jack installed on a roof according to aspects of the present invention.
Figure 10:
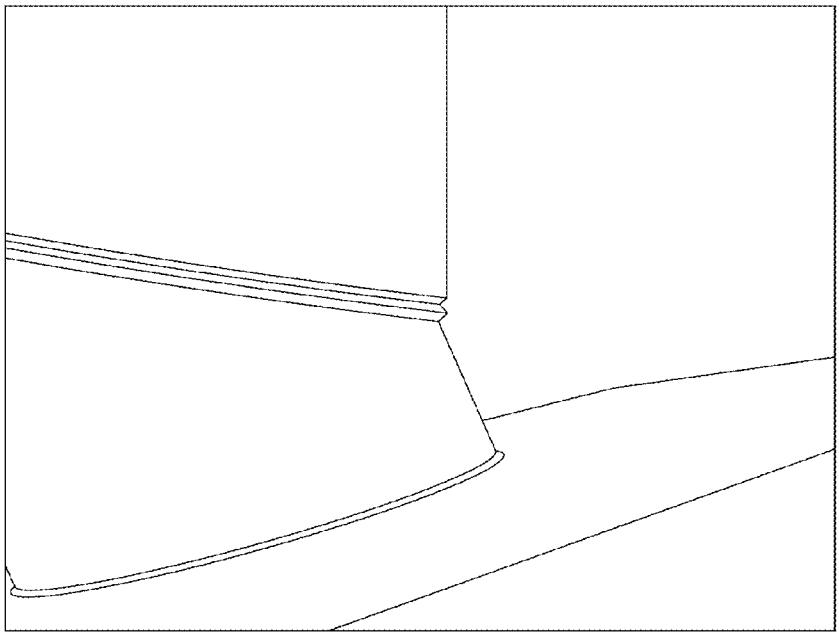
FIG. 10 shows a side view of a roof jack according to aspects of the present invention.

The pitch of a roof is measured by resting a board at one end on the roof and then placing a level on the board, so that it extends outwardly horizontally from the roof. At a point twelve inches from the contact point of the board on the roof, the distance between the board and the roof is measured. If this distance, for example, is three inches, the pitch is 3-in-12. FIGS. 6-9 depict the present invention at varying pitches. For example, FIG. 6 depicts a roof jack according to the present invention installed on a roof with a 4-in-12 pitch. FIG. 7 depicts a roof jack according to the present invention installed on a roof with a 5-in-12 pitch. FIG. 8 depicts a roof jack according to the present invention installed on a roof with a 6-in-12 pitch. FIG. 9 depicts a roof jack according to the present invention installed on a roof with a 7-in-12 pitch. While four roof pitches are shown, the present invention is designed to accommodate each pitch from 0-in-12 (0:12) to 12-in-12 (12:12).

The flange (102) may be attached to and/or surround any conduit into and out of the roof of a structure. All of the parts of the roof jack may be made of flat galvanized sheet steel of the type commonly used for air conditioning and heating ductwork.

Figure 13:
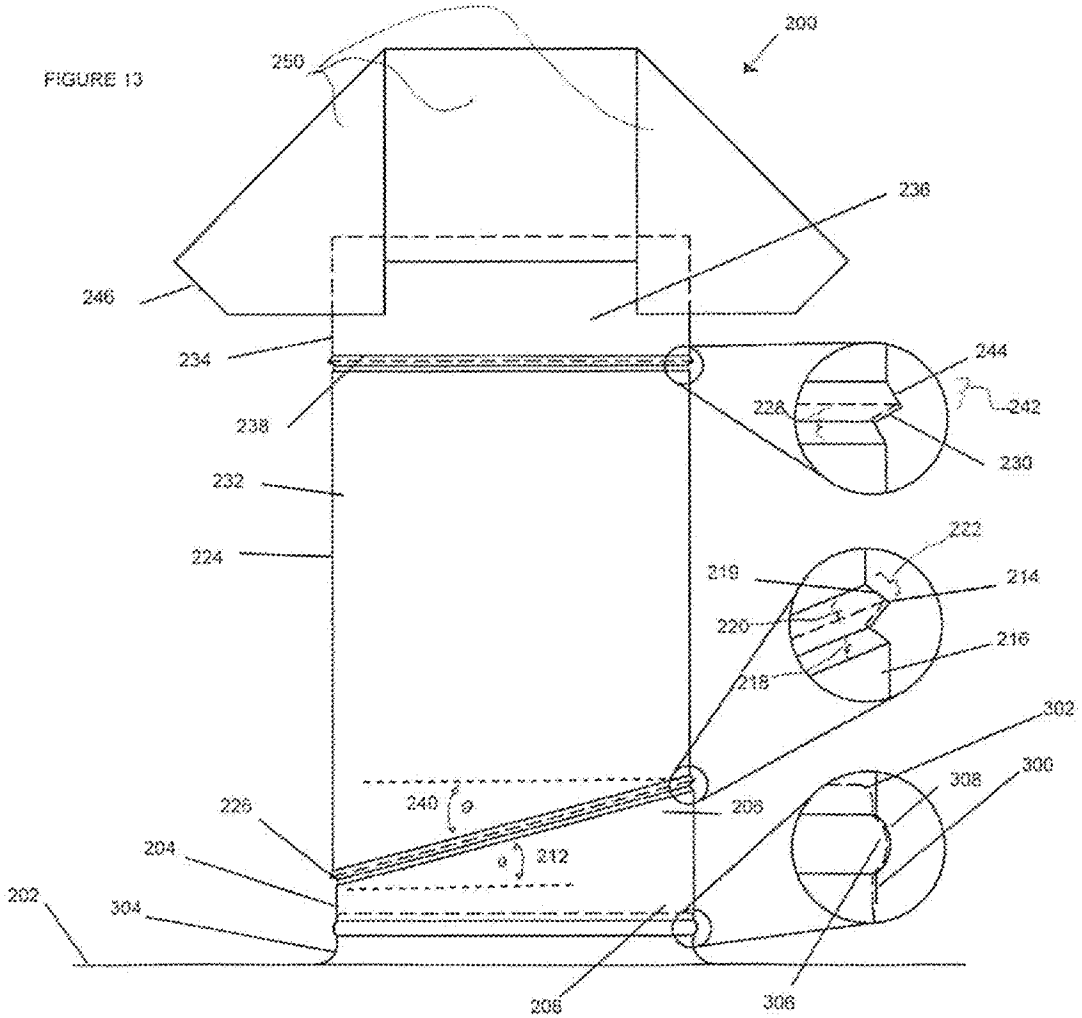
FIG. 13 depicts an alternate roof jack according to aspects of the present invention.
Figure 14:
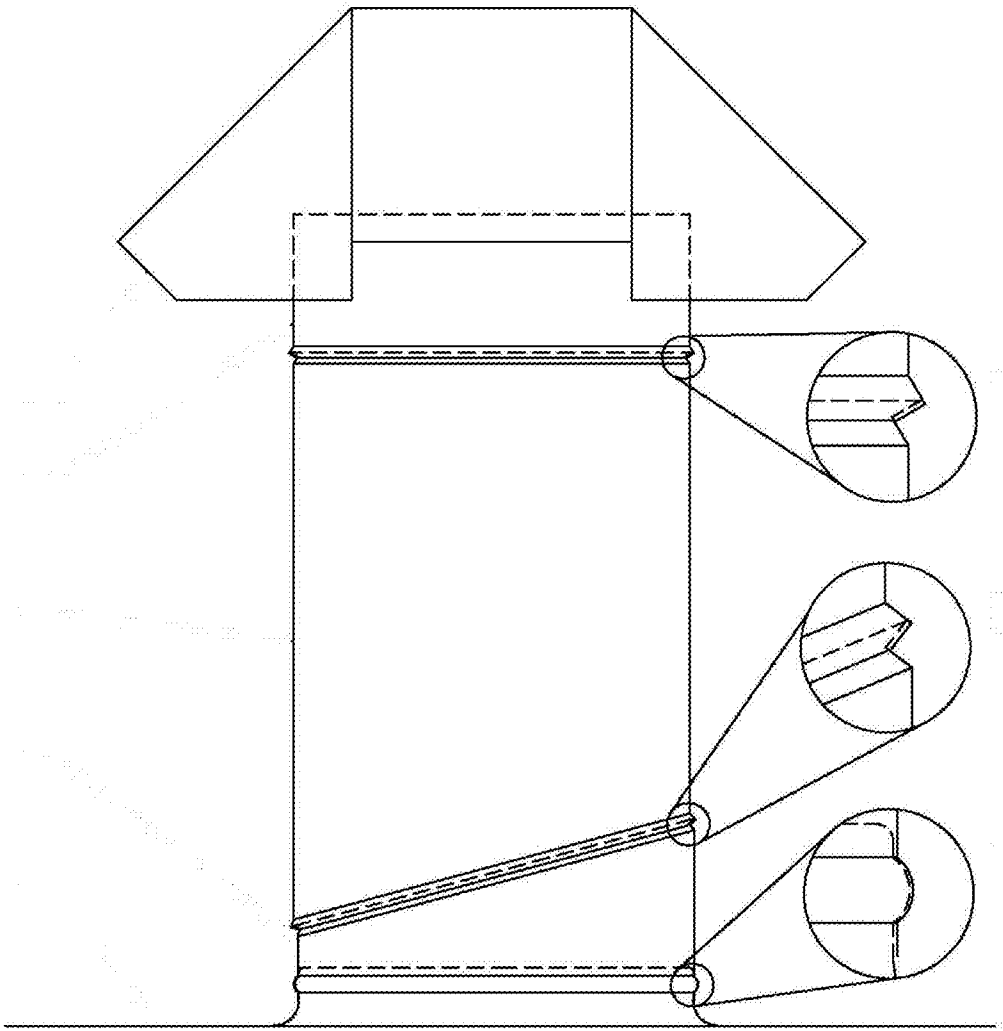
FIG. 14 depicts an alternate roof jack according to aspects of the present invention.

The flange (102) may be attached to and/or surround any conduit into and out of the roof of a structure. All of the parts of the roof jack may be made of flat galvanized sheet steel of the type commonly used for air conditioning and heating ductwork. FIGS. 13 and 14 depicts an embodiment of the adjustable roof jack (200), the adjustable roof jack comprising: a flange (202); a first cylinder (204) having a first cylinder top portion (206) and a first cylinder bottom portion (208), the first cylinder bottom portion (208) fixedly connected to the flange (202) (and surrounding a conduit in a structure) and the first cylinder top portion (206) being at an angle between 13 and 19 degrees and having at least one first cylinder fold (218) having a first cylinder fold raised portion (214); a second cylinder (224) having a second cylinder top portion (232) and a second cylinder bottom portion (226), the second cylinder bottom portion (226) being at an angle (240) between 71 and 77 degrees and having at least one second cylinder bottom fold (222) having a second cylinder bottom fold raised portion (219) and the second cylinder top portion (232) having at least one second cylinder top fold (228) having a second cylinder top fold raised portion (230), wherein the second cylinder bottom fold (222) is folded over the first cylinder fold raised portion (216) to fixedly and rotationally connect the second cylinder (224) to the first cylinder (204) at an angle (212) between 13 and 19 degrees a vent cap cylinder (234) having a vent cap cylinder top portion (236) and a vent cap cylinder bottom portion (238), the vent cap cylinder bottom portion (238) having at least one vent cap cylinder fold (242) having a vent cap cylinder fold raised portion (244), wherein the vent cap cylinder fold (242) is folded over the second cylinder top fold raised portion (230) to rotationally connect the vent cap cylinder (234) to the second cylinder (224); and a vent cap assembly (246) fixedly attached to the vent cap cylinder top portion (236).

The first cylinder bottom portion (208) may be further comprising a lip portion (304) fixedly attached to the flange. The lip portion (304) is curved between the first cylinder bottom portion (208) and the flange (202). This leads the water away from the first cylinder bottom portion (208). The first cylinder is further comprising a flange fastening seam.

The flange fastening seam, according to one embodiment, is made of two overlapping and interfitting parts, each with a raised round portion (306 and 308). The inner seam portion (302) is in watertight communication with the lip portion (304), has a raised round portion (306) and terminates at a top portion. The outer seam portion (300) is in watertight communication with, or is a part of, the first cylinder bottom portion (208), has a raised round portion (306) and terminates at a bottom portion. As can be seen, the outer seam portion (300) fits on top of and around the inner seam portion (302). The overlapping and interfitting nature of the inner seam portion (302) and the outer seam portion (300) creates a watertight flange fastening seam. FIG. 14 is the same Figure as FIG. 13, but shown unmarked for purposes of clarity.

Figure 15:
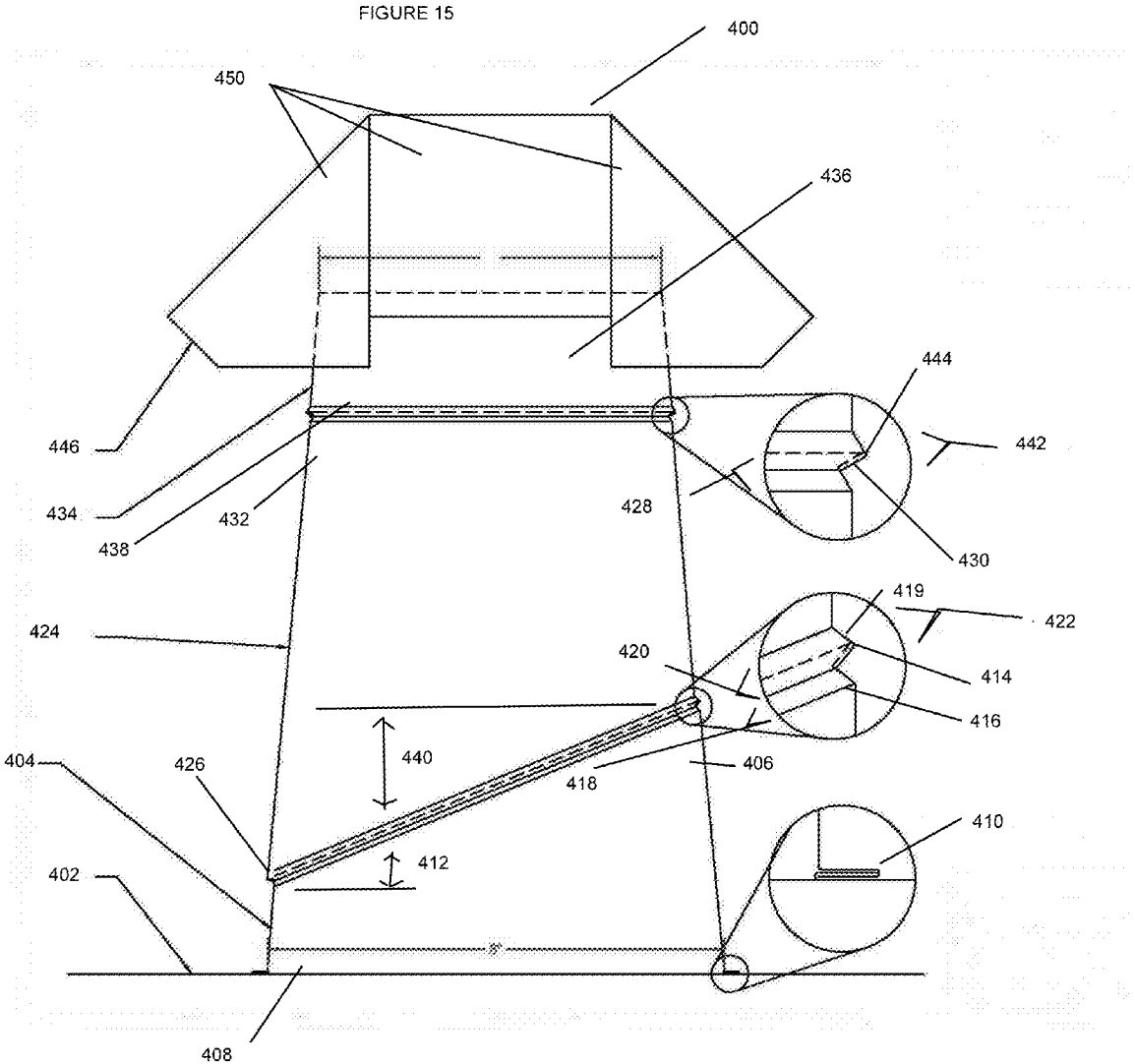
FIG. 15 depicts a side view of a roof jack according to the present invention.
Figure 16:
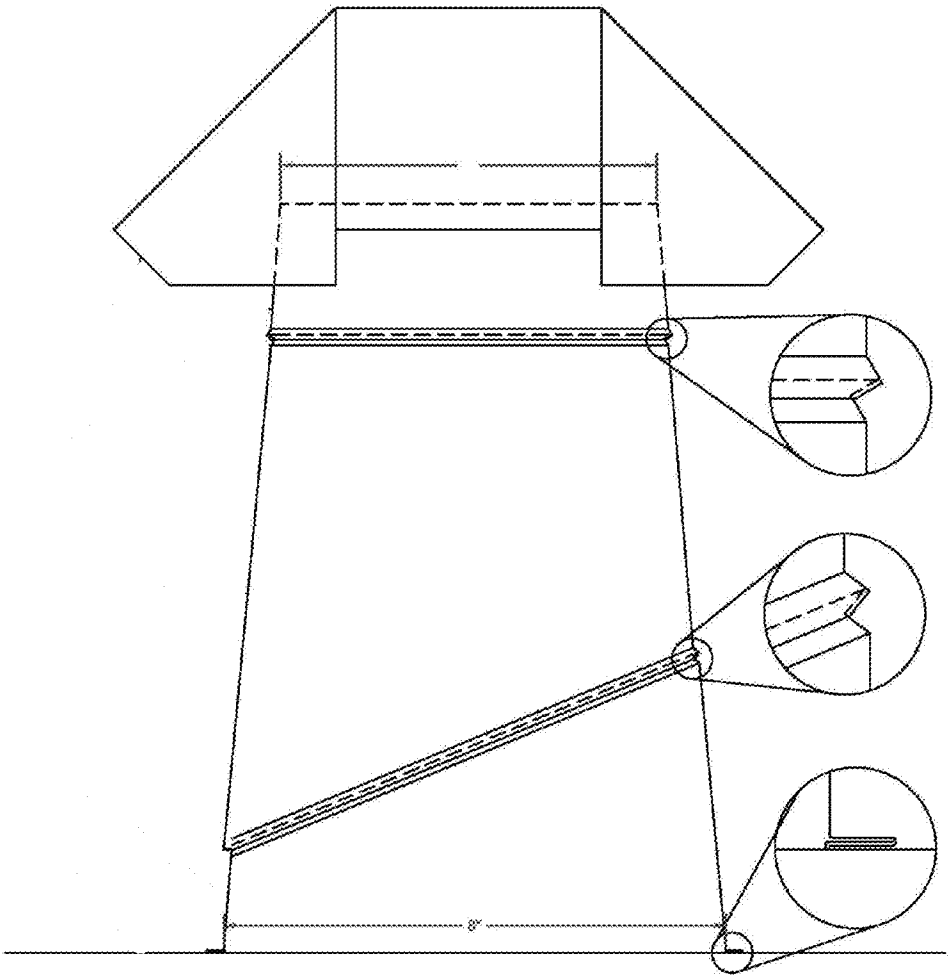
FIG. 16 depicts a side view of a roof jack according to the present invention.

FIG. 15 depicts an adjustable roof jack as in the present invention with tapered cylinders. The term tapered should be given its ordinary and customary meaning. One definition of tapered, that applies to the claims herein, is to become smaller or thinner toward one end. As shown in FIG. 15, an adjustable roof jack (400), the adjustable roof jack (400) comprising: a flange (402); a first tapered cylinder (404) having a first cylinder top portion (406) and a first cylinder bottom portion (408), the first cylinder bottom portion (408) fixedly connected to the flange (402) and the first cylinder top portion (406) having at least one first cylinder fold having a first cylinder fold raised portion (416); a second tapered cylinder (424) having a second cylinder top portion (432) and a second cylinder bottom portion (426), the second cylinder bottom portion (426) having at least one second cylinder bottom fold (422) having a second cylinder bottom fold raised portion (419) and the second cylinder top portion (432) having at least one second cylinder top fold (428) having a second cylinder top fold raised portion (430), wherein the second cylinder bottom fold (422) is folded over the first cylinder fold raised portion (416) to fixedly and rotationally connect the second tapered cylinder (424) to the first tapered cylinder (404); a vent cap tapered cylinder (434) having a vent cap cylinder top portion (436) and a vent cap cylinder bottom portion (438), the vent cap cylinder bottom portion (438) having at least one vent cap cylinder fold (442) having a vent cap cylinder fold raised portion (444), wherein the vent cap cylinder fold (442) is folded over the second cylinder top fold raised portion (430) to rotationally connect the vent cap tapered cylinder (434) to the second tapered cylinder (424); and a vent cap assembly (446) fixedly attached to the vent cap tapered cylinder top portion (436).

There may be a folded seam (420) along a bottom outside edge of the first cylinder bottom portion (408) and fixedly attached to the flange (402). The folded seam (410) between the first cylinder bottom portion (408) and the flange (402) is not rotational. At least one of the first cylinder fold (418), second cylinder bottom fold (422), second cylinder top fold (428) and vent cap cylinder fold (442) may be v shaped. At least one of the first cylinder fold (418) and second cylinder top fold (428) may be an end slanted l shape. FIG. 11 depicts an end slanted l shape. The term "end slanted" refers to the end being slightly curved in to allow the v shaped vent cap cylinder fold (442) to smoothly rotate around second cylinder top fold (428). The vent cap may be many different shapes (an infinite number) without departing from the scope of the present invention. It is only required that there be a top that prevents water from entering the cylinders and there be at least one opening that allows for ventilation.

The at least one first cylinder fold may be two first cylinder folds (418, 420), one first cylinder fold (418) being a v shaped fold and a second first cylinder fold (420) being an end slanted l shape and continuous with the first cylinder fold (418). The first cylinder top portion (406) may be at an angle (412) substantially 22.5 degrees and the second cylinder bottom portion (426) may be at an angle (440) substantially 67.5 degrees. Note each of cylinders (e.g. first cylinder (404), second cylinder (424) and vent cap cylinder (434)) are connected by rotational seams. The term rotational seam refers to (1) the connection formed by the second cylinder bottom fold (422) folded over the first cylinder fold raised portion (416) to fixedly and rotationally connect the second cylinder (424) to the first cylinder (404); and (2) the connection formed by the vent cap cylinder fold (442) folded over the second cylinder top fold raised portion (430) to rotationally connect the vent cap cylinder (434) to the second cylinder (424)

The rotational seams cannot be separated, and provide for watertight interlocking rotation. The seam which connects the second cylinder (424) to the first cylinder (404) may be at an angle that is approximately 22 degrees (angle 412). According to another preferred embodiment, the seam which connects the second cylinder (424) to the first cylinder (404) may be at an angle that is 15 degrees (angle 412). This allows the jack to accommodate each pitch from 0:12 through 12:12 (0-45 degrees). The seam connecting parts the second cylinder (424) and the vent cap cylinder (434) may be 0.0 degrees; its purpose is to provide rotation of the cap, enabling the installer to align it with the roof's edge for aesthetic appeal.

The vent cap assembly (446) may be comprising: a square vent cap top (448) and at least two canopies (450), according to one embodiment four canopies, in communication with the vent cap top (448) that extend from the vent cap top (448) to at least halfway past the vent cap cylinder (434). The term canopy refers to an overhang projection. Note that it is open under the canopy to allow air to flow into and out of a conduit in the roof, a first tapered cylinder (404), second tapered cylinder (424) and vent cap tapered cylinder (434).

The present invention has been described in relation to particular examples, which are intended to be illustrative rather than restrictive, with the scope and spirit of the invention being indicated by the following claims and their equivalents.

The invention claimed is:

1. An adjustable roof jack, said adjustable roof jack comprising:

a flange;

a first tapered cylinder having a first cylinder top portion and a first cylinder bottom portion, the first cylinder bottom portion fixedly connected to the flange and the first cylinder top portion having at least one first cylinder fold having a first cylinder fold raised portion;

a second tapered cylinder having a second cylinder top portion and a second cylinder bottom portion, the second cylinder bottom portion having at least one second cylinder bottom fold having a second cylinder bottom fold raised portion and the second cylinder top portion having at least one second cylinder top fold having a second cylinder top fold raised portion, wherein the second cylinder bottom fold is folded over the first cylinder fold raised portion to fixedly and rotationally connect the second tapered cylinder to the first tapered cylinder;

a vent cap tapered cylinder having a vent cap cylinder top portion and a vent cap cylinder bottom portion, the vent cap cylinder bottom portion having at least one vent cap cylinder fold having a vent cap cylinder fold raised portion, wherein the vent cap cylinder fold is folded over the second cylinder top fold raised portion to rotationally connect the vent cap tapered cylinder to the second tapered cylinder; and a vent cap assembly fixedly attached to the vent cap tapered cylinder top portion.

2. An adjustable roof jack as in claim 1, further comprising a folded seam along a bottom outside edge of the first cylinder bottom portion and fixedly attached to the flange.

3. An adjustable roof jack as in claim 1, wherein at least one of the first cylinder fold, second cylinder bottom fold, second cylinder top fold and vent cap cylinder fold is v shaped.

4. An adjustable roof jack as in claim 1, wherein at least one of the first cylinder fold and second cylinder top fold is an end slanted l shape.

5. An adjustable roof jack as in claim 1, wherein said at least one first cylinder fold is two first cylinder folds, one first cylinder fold being a v shaped fold and a second first cylinder fold being an end slanted l shape and continuous with the first cylinder fold.

6. An adjustable roof jack as in claim 1, wherein the first cylinder top portion is at an angle between 20 and 25 degrees, preferably substantially 22 degrees, and the second cylinder bottom portion is at an angle between 65 and 70 degrees, substantially 68 degrees.

7. An adjustable roof jack as in claim 1, wherein the first cylinder top portion is at an angle between 10 and 25 degrees, preferably substantially 15 degrees, and the second cylinder bottom portion is at an angle between 65 and 80 degrees, substantially 75 degrees.

8. An adjustable roof jack as in claim 1, said a vent cap assembly comprising:

a vent cap top;

at least two canopies in communication with the vent cap top that extend from the vent cap top to at least halfway past the vent cap tapered cylinder.

9. An adjustable roof jack as in claim 1, said vent cap assembly comprising:

a square vent cap top;

four canopies in communication with the square vent cap top that extend from the vent cap top to at least halfway past the vent cap tapered cylinder.

10. An adjustable roof jack as in claim 1, wherein said flange is octagonal, circular, square or rectangular shaped.

11. An adjustable roof jack as in claim 1, said vent cap assembly having a vent cap top that is a square vent cap, round vent cap or wagon vent cap.

12. An adjustable roof jack, said adjustable roof jack comprising:

an octagonal shaped flange;

a first tapered cylinder having a first cylinder top portion and a first cylinder bottom portion, the first cylinder bottom portion fixedly connected to the octagonal shaped flange at a substantially zero degree angle and the first cylinder top portion having two first cylinder folds, one first cylinder fold being a v shaped fold having a first cylinder fold raised portion and a second first cylinder fold being an end slanted l shape and continuous with the one first cylinder fold being a v shaped fold;

a second tapered cylinder having a second cylinder top portion and a second cylinder bottom portion, the second cylinder bottom portion having one second cylinder bottom v shaped fold having a second cylinder bottom fold raised portion and the second cylinder top portion having at least one second cylinder top fold having a second cylinder top fold raised portion, wherein the second cylinder bottom fold is folded over the second first cylinder fold being an end slanted l shape to fixedly and rotationally connect the second tapered cylinder to the first tapered cylinder;

a vent cap tapered cylinder having a vent cap cylinder top portion and a vent cap cylinder bottom portion, the vent cap cylinder bottom portion having at least one vent cap cylinder fold having a vent cap cylinder fold raised portion, wherein the vent cap cylinder fold is folded over the second cylinder top fold raised portion to rotationally connect the vent cap tapered cylinder to the second tapered cylinder; and a vent cap assembly fixedly attached to the vent cap tapered cylinder top portion.

13. An adjustable roof jack as in claim 12, further comprising a folded seam along a bottom outside edge of the first cylinder bottom portion and fixedly attached to the octagonal shaped flange.

14. An adjustable roof jack as in claim 12, wherein at least one of the first cylinder fold, second cylinder bottom fold, second cylinder top fold and vent cap cylinder fold is v shaped.

15. An adjustable roof jack as in claim 12, wherein at least one of the first cylinder fold and second cylinder top fold is an end slanted l shape.

16. An adjustable roof jack as in claim 12, wherein said at least one first cylinder fold is two first cylinder folds, one first cylinder fold being a v shaped fold and a second first cylinder fold being an end slanted l shape and continuous with the first cylinder fold.

17. An adjustable roof jack as in claim 12, wherein the first cylinder top portion is at an angle between 20 and 25 degrees, preferably substantially 22.5 degrees, and the second cylinder bottom portion is at an angle between 65 and 70 degrees, substantially 67.5 degrees.

18. An adjustable roof jack as in claim 12, wherein the first cylinder top portion is at an angle between 20 and 25 degrees, preferably substantially 22 degrees, and the second cylinder bottom portion is at an angle between 65 and 70 degrees, substantially 68 degrees.

19. An adjustable roof jack as in claim 12, said a vent cap assembly comprising:

a vent cap top;

at least two canopies in communication with the vent cap top that extend from the vent cap top to at least halfway past the vent cap tapered cylinder.

20. An adjustable roof jack as in claim 12, said vent cap assembly comprising:

a square vent cap top;

four canopies in communication with the square vent cap top that extend from the vent cap top to at least halfway past the vent cap cylinder.

* * * * *